US005220945A

United States Patent [19]

Vandeweghe et al.

[11] Patent Number: 5,220,945

[45] Date of Patent: Jun. 22, 1993

[54] SUPPORTING DEVICE FOR THE BACK REST IN A WEAVING MACHINE

[75] Inventors: Michel Vandeweghe, Wijtschate-Heuvelland; Bart Lefever, Ieper, both of Belgium

[73] Assignee: Picanol N.V., Naamloze Vennotschap, Ieper, Belgium

[21] Appl. No.: 795,809

[22] Filed: Nov. 21, 1991

[30] Foreign Application Priority Data

Nov. 22, 1990 [BE] Belgium ..... 09001113

[51] Int. Cl.[5] ..... D03D 49/22

[52] U.S. Cl. ..... 139/114

[58] Field of Search ..... 139/114, 110

[56] References Cited

U.S. PATENT DOCUMENTS

| | | | |
|---|---|---|---|
| 2,951,509 | 9/1960 | Pfarrwaller | 139/114 |
| 4,193,428 | 3/1980 | Demuth . | |
| 4,572,244 | 2/1986 | Kojima et al. | 139/110 X |
| 5,025,838 | 6/1991 | Vandeweghe et al. | 139/114 |

*Primary Examiner*—Andrew M. Falik

*Attorney, Agent, or Firm*—Bacon & Thomas

[57] ABSTRACT

Supporting device for the back rest in a weaving machine, characterized in that it mainly consists of a first element (13) which can move in relation to a frame (14) and a second element (15) upon which the back rest (3) has been mounted, whereby this second element (15) is attached to the first element (13) in a hingeable manner on the one hand, and is being supported by elastic element (17) on the other hand.

11 Claims, 3 Drawing Sheets 12
23
22
21
2
31
13
27
40
28
30
17
32
34
14
19
18
3
35
15
24
33
29
30
39
31
26
16
25
27
23
20
22
A
38
37
36

SUPPORTING DEVICE FOR THE BACK REST IN A WEAVING MACHINE

BACKGROUND OF THE INVENTION

The present invention concerns a supporting device for the back rest in a weaving machine.

It is known that a supporting device for the back rest in a weaving machine consists of a lever which supports the back rest and which is loaded by means of a spring and/or damper. Such arrangement is disadvantageous in that it is difficult to be integrated in a supporting mechanism which imposes a periodical to-and-fro movement on the back rest in concordance with the weaving cycle, better known as the "easing motion".

Known embodiments in which use is made of a so-called "easing motion" are disadvantageous in that the suspension for the back rest is not sufficiently resilient, as a result of which these embodiments make it impossible to set the optimum resilient effect for a particular fabric.

SUMMARY OF THE INVENTION

The present invention concerns a supporting device which does not show said disadvantages, as the spring force exerted upon the back rest does not depend on the driving means of the "easing motion".

To this end, the invention concerns a supporting device for the back rest in a weaving machine, including a first element supported for movement in relation to a frame and a second element upon which the back rest has been mounted, one end of the second element being pivotally attached to the first element by a hinge, and the second end being supported by elastic means. This supporting device is advantageous in that it is compact and easy to mount.

BRIEF DESCRIPTION OF THE DRAWINGS

In order to better explain the characteristics according to the invention, by way of example only and without being limitative in any way, the following preferred embodiment is described with reference to the accompanying drawings, where.

DETAILED DESCRIPTION OF THE PREFERRED EMBODIMENTS

Figure 1:
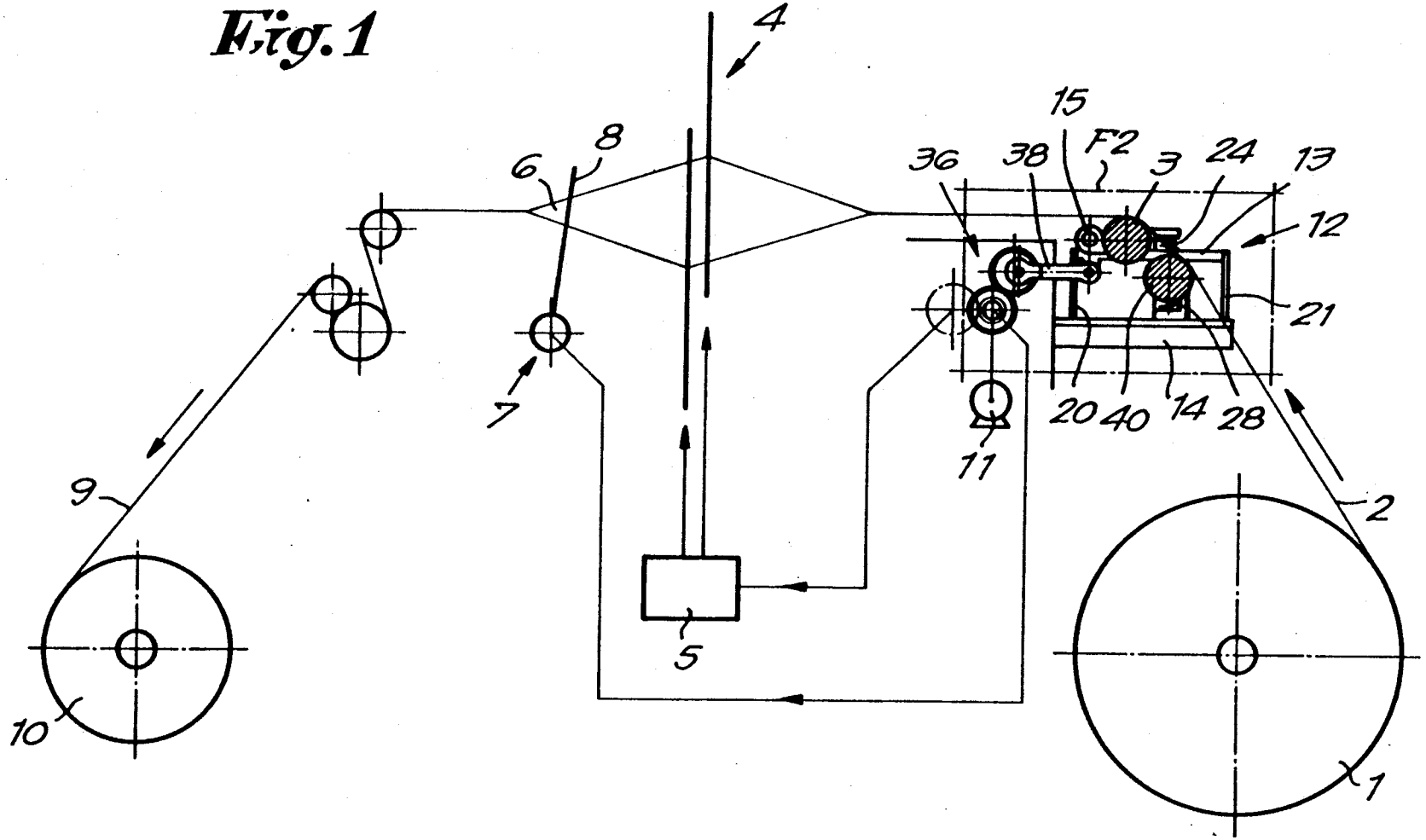
FIG. 1 is a schematic representation of a weaving machine provided with a supporting device according to the invention.

In order to better explain the invention, FIG. 1 is a schematic representation of a weaving machine having as main parts the warp beam 1, the warp 2, the back rest 3, the harnesses 4, the harness drive 5, the shed 6, the sley 7 with the reed 8, the fabric being woven 9, the cloth roll 10 and the main drive motor 11. The back rest 3 is preferably mounted near each end in a supporting device 12 according to the invention.

Figure 2:
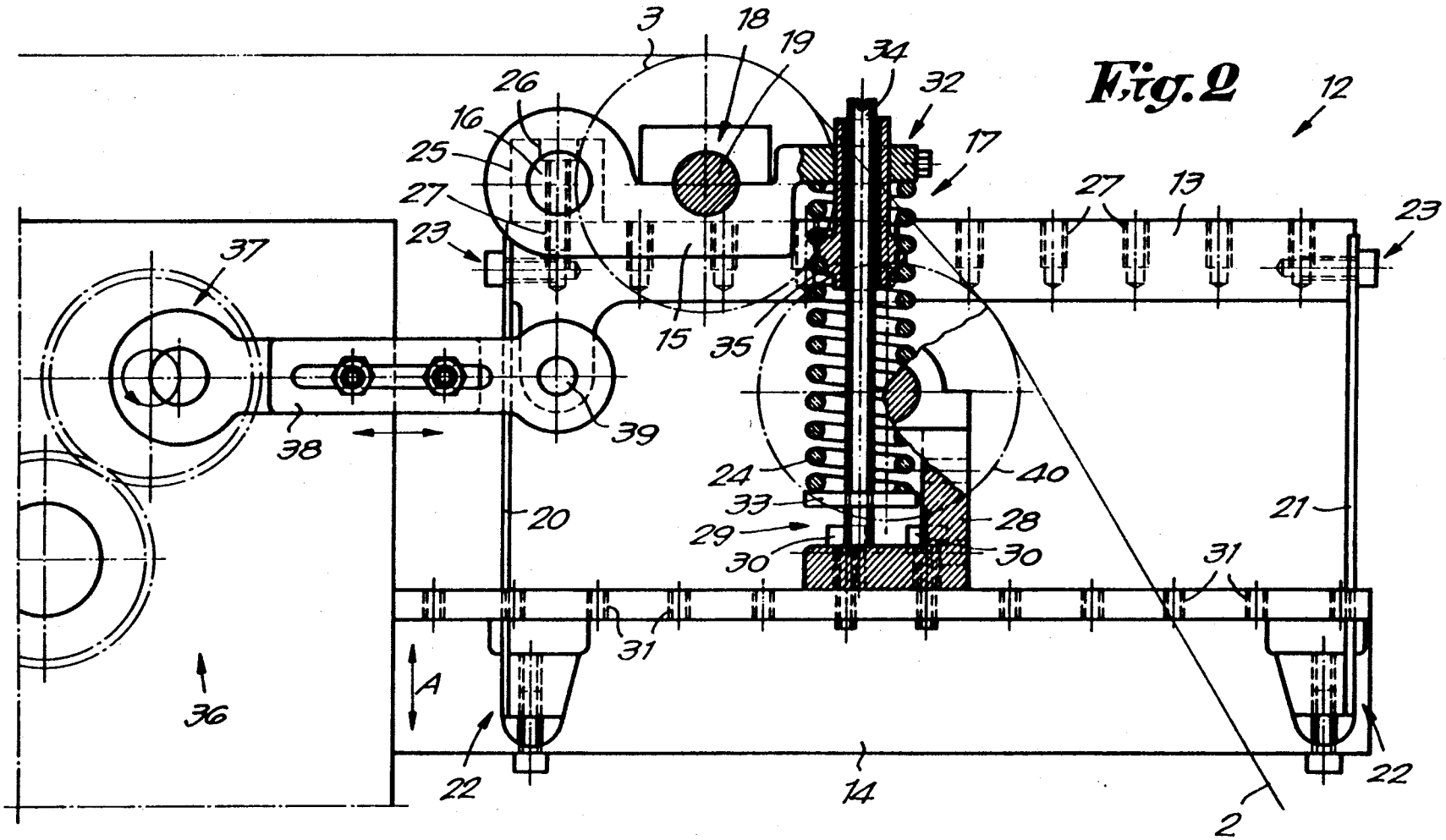
FIG. 2 shows a view to a greater scale of the part that is indicated in FIG. 1 with F2.
Figure 3:
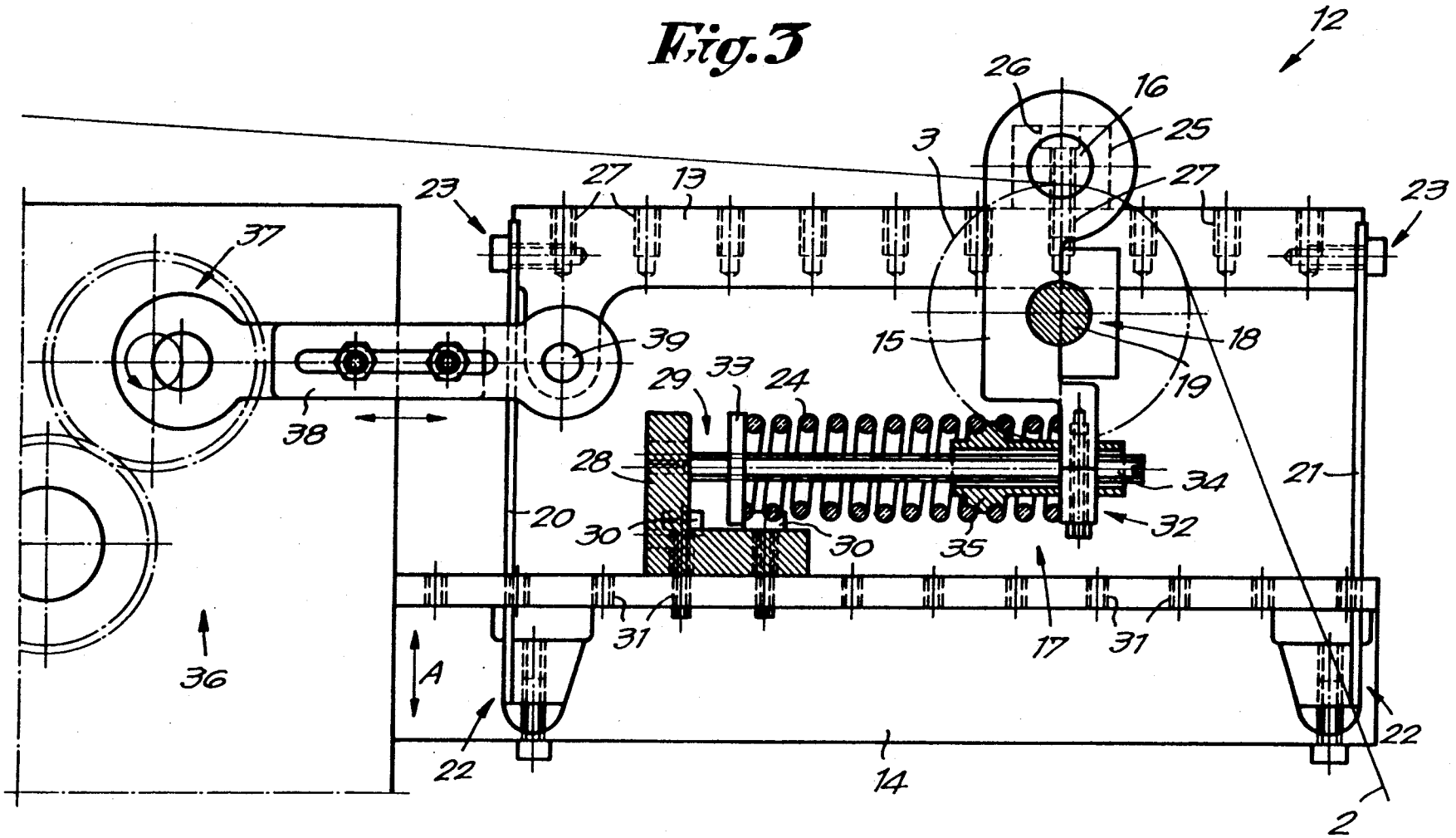
FIG. 3 shows the part represented in FIG. 2, but for a different arrangement.

This supporting device 12 is shown in detail in the FIGS. 2 and 3 and mainly consists of a first element 13 which can move in relation to the frame 14 and a second element 15.

This second element 15 is attached to the element 13 in a pivotal manner, and can rotate around a shaft 16. Moreover, this second element 15 is supported by means of elastic means 17, which in turn preferably are supported to rest on the frame 14.

The shaft 16 and the elastic means 17 are situated in preference at the opposite ends of the second element 15. In the middle of the second element 15 there is a seating 18 for the shaft end 19 of the back rest 3.

The first element 13 is preferably mounted on the frame 14 by means of supporting means which allow for a parallel movement of the first element 13 in relation to itself, i.e., to be oriented in parallel planes as it moves in relation to the frame. As shown in the figures, these supporting means consist of, for example, at least two leaf springs 20 and 21 mounted parallel to each other, which, at one end 22, are fixed in the frame 14 by means of a key fixture and which, at the other end 23 are attached onto the first element 13 by means of a bolted joint. This arrangement makes it possible to adjust the length of the leaf springs.

Of course, the leaf springs 20 and 21 have been mounted such that the first element 13 can move according to a direction which is transversely to the longitudinal direction of the back rest 3.

The leaf springs 20 and 21 preferably have such dimensions that they enable the first element 13 to move according to its own frequency during the weaving such that the energy supply required for this movement is minimal.

The elastic means 17 preferably consist of a compression spring 24 or any other elastic element whatsoever.

According to a special characteristic of the invention, the second element 15 can move towards the first element 13, such according to a direction which is transversely to the longitudinal direction of the back rest 3. To this end, the shaft 16 has been fixed in a support 25 which can be mounted at several places on the first element 13. To this end, the support 25 can be fixed in bore holes 27 by means of one or several fixing means such as bolts 26. To this end, the first element 13 must be positioned mainly parallel to the frame 14.

The above-mentioned spring 24 is mounted near the frame 14 in a support 28, which has been provided with a seating 29 to this end. Analogous to the support 25, this support 28 can be attached to the frame 14 at different places. The support 28 can be fixed by means of bolts 30 which operate in conjunction with one or several bore holes 31 in the frame 14.

The geometry of the whole is preferably such that the second element 15 can be arranged in two positions, parallel and perpendicular to the first element 13 respectively. The first case is represented in FIG. 2, whereas the second case is represented in FIG. 3.

As shown in the FIGS. 2 and 3, the support 28 can also be mounted in two different positions on the frame 14.

The position of the end 32 of the second element 15 which operates in conjunction with the elastic, compressible means 17 is preferably adjustable, one and other such that the element 15 can always be placed parallel or perpendicular to the first element 13, irrespective of the tension in the warp 2. To this end, as shown in the FIGS. 2 and 3, use can be made of adjusting means such as a supporting plate 33 for the compression spring 24, which can be removed from the support at a greater or lesser distance by means of a threaded rod 34.

The rigidity of the elastic means 17 can be altered by putting an element 35 in the compression spring 24 which immobilizes a number of coils of the compression spring 24, whereby this element 35 is being tightened in the end 32.

The frame 14 may be adjustable in height in relation to the frame of the weaving machine, as indicated by the arrow A. This can be done in an analogous manner as for the supporting plate 33 and/or by means of screwing means. It should be noted that in the embodiment shown the height adjustment of the frame 14 has no influence whatsoever on the moving direction of the first element 13.

Normally, the supporting device 12 will be coupled to a drive mechanism 36 providing a to-and-fro movement of the first element 13, better known as the "easing motion". Such drive mechanism 36 may consist of an adjustable eccentric 37 which is driven by means of a motor, for example the main motor 11. According to the invention, the movement of the eccentric 37 is transmitted to the first element 13 by means of an arm 38 and a hinge point 39.

The arrangement according to FIG. 2 will usually be used for normally elastic yarn whereas the arrangement according to FIG. 3 will be used for very elastic yarn. In the latter case, the eccentricity of the eccentric 37 will be set as low as possible.

A second fixed back rest roll 40 can be mounted in the supporting device 12, which for example, as shown in FIG. 2, has been applied on the support 28.

The present invention is not limited in any way to the embodiment described by way of example and shown in the accompanying drawings; on the contrary, such a supporting device can be made in all sorts of variants while still remaining within the scope of the invention.

We claim:

1. A supporting device for a back rest in a weaving machine, comprising:

a first element;

first element support means for supporting the first element to move in relation to a frame;

a second element;

back rest mounting means for mounting the back rest on the second element;

hinge means for pivotally connecting a first end of the second element to the first element; and elastic means for elastically supporting a second end of the second element.

2. A supporting device as claimed in claim 1, wherein said first element support means comprises means for supporting said first element to be oriented in parallel planes as it moves in relation to the frame.

3. A supporting device as claimed in claim 2, wherein said first element support means comprises at least two parallel leaf springs.

4. A supporting device as claimed in claim 1, further comprising means for mounting said elastic means to rest on said frame.

5. A supporting device as claimed in claim 4, wherein said first element mounting means comprises means for mounting said first element parallel to said frame.

6. A supporting device as claimed in claim 1, wherein said elastic means comprises a compression spring.

7. A supporting device as claimed in claim 1, wherein said hinge means and said elastic means comprise means for mounting said second element in one of at least two positions, one of said two positions being parallel to said first element and a second of said two positions being perpendicular to said first element.

8. A supporting device as claimed in claim 1, further comprising means for mounting the hinge means and the elastic means at different locations on the frame, thereby permitting a position of said second element relative to said first element and said frame to be adjusted in a direction which is transverse to a direction in which the back rest extends.

9. A supporting device as claimed in claim 8, wherein said hinge means comprises a shaft mounted in a first support, and said device further comprises means including a second support for mounting the elastic means to the frame, and wherein said means for mounting the hinge means and the elastic means comprises means for respectively attaching said first and second supports to the first element and to the frame by means of bolts and series of bore holes respectively provided in said first element and said frame for receiving said bolts.

10. A supporting device as claimed in claim 1, further comprising a drive mechanism and means for coupling the first element to the drive mechanism for moving said first element in a periodic motion.

11. A supporting device as claimed in claim 1, further comprising means for adjusting a position of the second end of the second element.

* * * * *